US008146515B2

(12) United States Patent
Trickett

(10) Patent No.: US 8,146,515 B2
(45) Date of Patent: Apr. 3, 2012

(54) SLIP SHEET FOR TRANSPORTING GOODS

(76) Inventor: Howard J. Trickett, Hartville, OH (US)

( * ) Notice: Subject to any disclaimer, the term of this patent is extended or adjusted under 35 U.S.C. 154(b) by 0 days.

(21) Appl. No.: 11/828,972

(22) Filed: Jul. 26, 2007

(65) Prior Publication Data

US 2008/0022905 A1 Jan. 31, 2008

Related U.S. Application Data

(60) Provisional application No. 60/833,635, filed on Jul. 26, 2006.

(51) Int. Cl.
*B65D 19/38* (2006.01)

(52) U.S. Cl. ..... 108/55.5; 108/51.11; 108/51.3; 248/346.02

(58) Field of Classification Search ..... 108/51.11, 108/51.3, 53.1, 53.3, 53.5, 55.1, 55.3, 55.5, 108/57.2, 52.1, 901, 902; 248/346.02
See application file for complete search history.

(56) References Cited

U.S. PATENT DOCUMENTS

| | | | | | |
|---|---|---|---|---|---|
| 2,611,569 | A | * | 9/1952 | Coleman et. al. | 108/51.3 |
| 2,774,490 | A | | 12/1956 | Strong | |
| 2,895,608 | A | | 7/1959 | Wilson | |
| 2,913,206 | A | | 11/1959 | Paris | |
| 2,918,242 | A | | 12/1959 | Olivette et al. | |
| 2,960,244 | A | | 11/1960 | Strong | |
| 3,282,621 | A | | 11/1966 | Peterson | |
| 3,347,185 | A | * | 10/1967 | Colas | 108/55.5 |
| 3,416,652 | A | | 12/1968 | Almasy | |
| 3,472,363 | A | * | 10/1969 | Overton et al. | 108/55.1 |
| 3,753,407 | A | * | 8/1973 | Tilseth | 108/53.3 |
| 3,776,145 | A | | 12/1973 | Anderson | |
| 3,788,462 | A | | 1/1974 | Meincer | |
| 3,850,115 | A | | 11/1974 | Mackes | |
| 3,850,116 | A | | 11/1974 | Mackes | |
| D237,468 | S | | 11/1975 | Adrews | |
| RE29,192 | E | * | 4/1977 | Anderson et al. | 108/51.3 |
| 4,042,127 | A | | 8/1977 | Brossia | |
| 4,300,867 | A | | 11/1981 | Frees | |
| 4,405,673 | A | | 9/1983 | Fridley et al. | |
| 4,445,614 | A | * | 5/1984 | Mitsumori et al. | 108/53.1 |
| 4,475,703 | A | * | 10/1984 | Nordgren | 108/51.3 |
| 4,507,348 | A | * | 3/1985 | Nagata et al. | 108/57.25 |
| 4,570,546 | A | | 2/1986 | Batelka | |
| 4,649,007 | A | | 3/1987 | Bonis | |
| 4,735,153 | A | | 4/1988 | Wong | |
| 4,852,330 | A | | 8/1989 | Carangelo | |
| 4,871,063 | A | | 10/1989 | Kumbler | |

(Continued)

FOREIGN PATENT DOCUMENTS

| | | |
|---|---|---|
| GB | 800453 | 8/1958 |

(Continued)

*Primary Examiner* — Jose V Chen
(74) *Attorney, Agent, or Firm* — Zollinger & Burleson Ltd.

(57) ABSTRACT

A slip sheet for use with unitized loads has a plurality of banding anchors. The banding anchors extend from an edge of the slip sheet or from a portion of the slip sheet tab. The banding anchors may be provided on one, two, three, or four edges of the slip sheet. The banding anchors may be folded up against the side of a unitized load to provide a place for packaging bands to engage the slip sheet. Portions of at least one slip tray sidewall are separated from the remaining sidewall to form flaps that may be folded down to function as tabs that help lift vehicles get under the slip tray.

29 Claims, 6 Drawing Sheets

U.S. PATENT DOCUMENTS

| | | | | | |
|---|---|---|---|---|---|
| 4,877,673 | A | | 10/1989 | Eckel | |
| 5,062,370 | A | | 11/1991 | Etlinger | |
| 5,111,754 | A | | 5/1992 | Adams, Jr. | |
| 5,208,084 | A | | 5/1993 | Rutz | |
| 5,226,372 | A | | 7/1993 | Frenkel et al. | |
| 5,383,408 | A | | 1/1995 | Searcy | |
| 5,441,154 | A | | 8/1995 | Youell | |
| 5,503,517 | A | * | 4/1996 | Derby | 414/814 |
| 5,535,668 | A | | 7/1996 | Besaw | |
| 5,549,341 | A | * | 8/1996 | Chase et al. | 108/55.5 |
| 5,570,643 | A | | 11/1996 | Werner | |
| 5,601,035 | A | | 2/1997 | Herring | |
| 5,613,447 | A | | 3/1997 | Trickett | |
| 5,660,118 | A | | 8/1997 | Adams, Jr. | |
| 5,772,369 | A | * | 6/1998 | Lerman et al. | 108/55.5 |
| 5,794,542 | A | | 8/1998 | Besaw | |
| 5,845,768 | A | | 12/1998 | Simpson | |
| 5,881,651 | A | | 3/1999 | Trickett | |
| 5,895,540 | A | | 4/1999 | David | |
| 5,934,474 | A | | 8/1999 | Renninger | |
| 6,041,718 | A | | 3/2000 | Brandes | |
| 6,070,726 | A | | 6/2000 | Graham | |
| 6,186,078 | B1 | | 2/2001 | Brown | |
| 6,490,982 | B1 | | 12/2002 | Trickett | |
| 2002/0002937 | A1 | * | 1/2002 | Modesitt et al. | 108/57.34 |
| 2006/0065169 | A1 | * | 3/2006 | Chen | 108/51.3 |
| 2008/0029421 | A1 | | 2/2008 | Trickett | |

FOREIGN PATENT DOCUMENTS

| | | | | |
|---|---|---|---|---|
| JP | 5051037 | | | 3/1993 |
| JP | 06278748 | A | * | 10/1994 |
| WO | WO 9100831 | | | 1/1991 |

* cited by examiner

SLIP SHEET FOR TRANSPORTING GOODS

CROSS REFERENCE TO RELATED APPLICATIONS

This application claims the benefit of U.S. Provisional Patent Application Ser. No. 60/833,635 filed Jul. 26, 2006; the disclosures of which are incorporated herein by reference.

BACKGROUND OF THE INVENTION

1. Technical Field

The present invention relates to packaging devices in the nature of slip sheets and slip sheets having sidewalls that are known as slip trays. More particularly, the invention relates to the structures and configurations of the tabs for slip sheets and slip trays.

2. Background Information

A wide variety of goods are packed into unitized loads for transport. Unitized loads used to be assembled onto wooden pallets. As the use of wooden pallets as diminished for a variety of reasons, the use of slip sheets and slip trays has increased. Those who use slip sheets often wrap the articles that form the unitized load on the slip with stretch wrap and banding. It is desired in the art to be able to connect the stretch wrap and/or the banding with the slip sheet.

Those who use slip sheets and slip trays also encounter problems when using known slip sheets with automated packing equipment developed for use with wooden pallets. The people who form the unitized loads on slip trays would like a slip sheet that may be used with an automated banding machine similar to those used with unitized loads formed on wooden pallets.

Further, those who use slip sheets and slip trays desire improved features for securing the loads to the sheets/trays as well as features for lifting the sheets/trays with push-pulls or forklifts.

BRIEF SUMMARY OF THE INVENTION

In one configuration, the invention provides a slip sheet with banding anchors. The banding anchors extend from an edge of the slip sheet or from a portion of the tab. The banding anchors may be provided on one, two, three, or four edges of the slip sheet. The banding anchors may be folded up against the side of a unitized load to provide a place for packaging bands to engage the slip sheet.

In another configuration, the invention provides a slip-sheet having a pair of tabs disposed along perpendicular edges. A fanned corner is provided between the ends of the tabs. One, two, three, or four webbed corners may be provided. The outer edge of the webbed corners may be crenulated or rounded. The webbed corners help keep the tabs from laying flat and help protect the ends of the tabs. The webbed corners also form a sealed basin that can hold liquids that may have spilled into the sheets.

In another configuration, the invention provides a slip sheet having at least one tab wherein the ends of the tab are angled so that the outer edge of the tab is smaller in length than the inner edge of the tab where the tab connects with the body of the slip sheet.

These configurations may be formed from a plastic material such as a recyclable material. In one configuration, the slip sheet may be formed from a corrugated polymer material with the corrugations running parallel to the tab. When two perpendicular tabs are desired, two slip sheets may be used together at right angles to each other. The sheets may be secured together with connectors, adhesives, or welds.

Another configuration of the invention provides a slip sheet having at least one tab that is scored to give the tab an upwardly curved configuration. The scored tab may define a plurality of banding openings. On configuration of this sheet forms the scored tab from a corrugated polymer material wherein the score lines are formed parallel to the corrugations.

Another configuration of the invention provides a slip tray having a base and a sidewall that may define banding openings. Portions of at least one sidewall are separated from the remaining sidewall to form flaps that may be folded down to function as tabs that help lift vehicles get under the slip tray. The flaps may be positioned to correctly align the forks of a forklift with the slip tray. These tabs may be scored to provide a curved configuration to the portions.

Another configuration of the invention provides a slip sheet tab having a plurality of indentations that make the tab easier to grip and to give the tab more rigidity. A different configuration provides a slip sheet base with the indentations.

These configurations may be used in combination with each other to form additional inventive combinations.

BRIEF DESCRIPTION OF THE DRAWINGS

The drawings are not to scale. Similar numbers refer to similar features throughout the specification. The drawings depict examples of the invention. The features shown in the drawings may be combined to form additional examples.

DETAILED DESCRIPTION OF THE INVENTION

Figure 1:
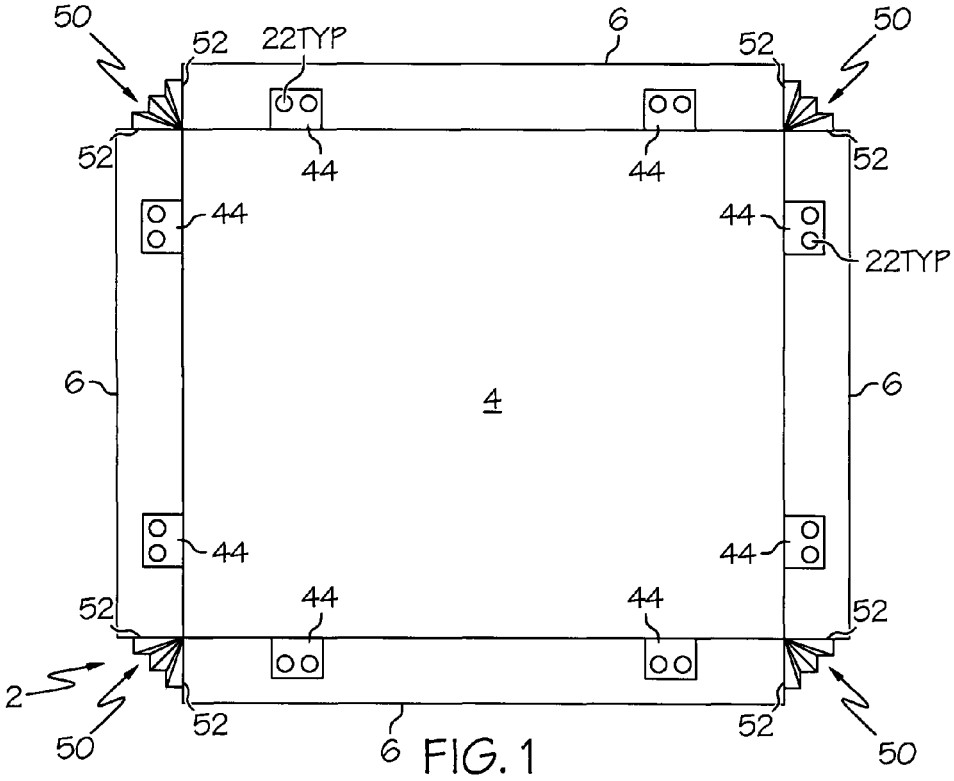
FIG. 1 is a top plan view of an exemplary slip sheet having banding anchors associated with all four tabs as well as four webbed corners.

The slip sheets described below are generally indicted by the numeral 2 in the accompany drawings. Slip sheet 2 generally includes at least a base 4 and a tab 6. For the purpose of providing an example of the invention and the manner in which the invention is used, Slips sheets 2 and slip trays 102 are described in conjunction with the transport of natural rubber bales. The method of transporting natural rubber in crumb and sheet form will be best understood when one first understands the natural rubber itself, which is generally a product of the tree *Hevea brasiliensis*. While synthetic rubbers have been developed, many applications still require the use of natural rubber, particularly the production of radial tires. The synthetic rubbers were developed during and after World War II, when U.S. companies determined to not be totally dependent on the Pacific Rim sources for natural rubber. However, the natural rubber sources are still a very important economic factor in world rubber production. A properly operated rubber plantation can produce in excess of 3000 pounds of rubber per acre per year, although the collecting and processing of the rubber can be very labor-intensive. In a rubber plantation, the trees are tapped in a manner to allow a rich white liquid, known as latex, to be accumulated into cups, which must be collected frequently to avoid putrefaction or contamination of the latex, which is a relatively unstable material. Carried to collection stations, the latex is strained to remove impurities and a preservative, such as ammonia, may be added. When the latex is treated by acids or acid salts, the latex separates into two phases in a process generally referred to as coagulation. The natural rubber separates from the liquid serum as a white, dough-like mass, which is then dried and ground to form crumbs or sheets. In this form, the rubber, which is chemically characterized as cis-1,4-polyisoprene, is sufficiently stable to enable stockpiling without further preservation means. However, the rubber will fuse with itself or flow when pressure is applied, and this feature, while allowing the rubber to be formed into rectangular sheets or bales, is also an unfortunate consequence which prevents excessive stacking of the sheets or bales.

Commercial rubber users prefer the rubber to be in bales of a convenient size, which is from about seventy to about eighty pounds, although the size of the bales varies greatly, depending on the producer and consumer. Such a size can be achieved using a bale having in the range of about 1.5 to 1.8 cubic feet of volume. The process of forming such a rectangular solid bale from the rubber is well known and will be well within the knowledge of one of skill in the rubber industry. Once formed, the bales are usually packaged in a plastic bag, although it is also known in the industry to package the bales in a shrink-wrap or stretch-wrap polymer, such as a polyethylene film. If for no other reason, this individual bale packaging minimizes the fusing of rubber in adjacent bales. A unitized load 10 is formed when the goods 12 (in this example the rubber bales) are arranged on the slip sheet. Unitized loads may be wrapped in a stretch wrap 14 layer to protect goods 12 and to prevent goods 12 from shifting.

To provide a base for forming and moving the transport unit of crumb rubber bales, a slip sheet 2 or a slip tray 102 is provided. Slip sheet 2 or slip tray 102 are made from a non-wooden material and preferably a polymeric material, even more preferably a recyclable material. Slip sheet 2 may be formed from a previously-processed polymer, that is, a polymer that has been previously subjected a thermal molding process and the degradation inherent therein. Slip sheet 2 may be manufactured from a material that lacks nutritive or nesting interest, particularly to insects, thereby preventing or at least minimizing insect infestation. The material may be impervious to moisture. These requirements effectively eliminate wood, corrugated paper, cardboard and similar materials from consideration. As shown in FIG. 1, an exemplary slip sheet 2 has a base 4 or "footprint" size being a rectangular area 4 about 54 inches wide by 41 inches long. These dimensions may change depending on the shipping application in which slip sheet 2 is used. The working area or "footprint" 4 is the space upon which the rubber may be stacked and the space which the transport unit occupies. The slip sheet 2 has a thickness that is significantly less than either the width or length, so that the slip sheet is in essence a two-dimensional body. The thickness for the slip sheet 10 is in the range of 0.015 inches to 0.100 inches and has been found to be effective for rubber bales in the range of 0.040 inches to 0.060 inches. To be effective, the slip sheet 10 must have sufficient rigidity to support the load, so a minimum thickness is required, but the slip sheet should not be much thicker than required, since additional thickness adds only weight and cost to the overall transport unit.

Polymeric materials that are useful for the slip sheet 2 include the polyolefins such as polyethylene, especially high density polyethylene ("HDPE") and polypropylene, as well as polyesters such as poly(ethylene terephthalate) ("PETE"). In addition to the use of "virgin" polymers, that is, polymer materials that have previously not been thermally processed or molded, slip sheet 2 may well be prepared from previously-processed polymer materials. To the extent that polyolefins and polyesters are available, desirable starting materials for the slip sheet may include recycled bottles and other containers. Slip sheet 2 and slip tray 102 may be formed be die cutting or by thermoforming.

Figure 6:
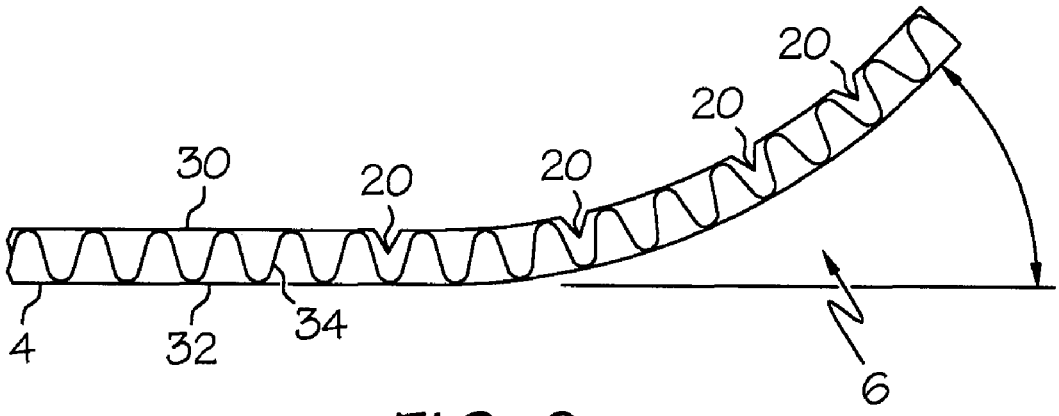
FIG. 6 is a view similar to FIG. 5 depicting a slip sheet and tab made from a corrugated polymer material.

Tab 6 is used to help get the lifting device—such as the forks of a forklift—under base 4 of slip sheet 2. As shown in the drawings, slip sheet 2 may include 1-4 of tabs 6. Tab 6 may be bent upwardly with respect to base 4 so that a portion of a lift vehicle may be fit under slip sheet 2. Tabs 6 may be scored with optional score lines 20 to impart an upwardly curved configuration to tab 6. Score lines 20 may be pressed into the upper surface of the material that forms slip sheet 2. Tab 6 may define banding openings 22 adapted to receive packaging bands that are wrapped around loads 10. In one configuration, slip sheet 2 is formed from a corrugated polymer having an upper liner 30, a lower liner 32, and a serpentine inner layer 34. The corrugated material has been found to have a desirable upwardly curved configuration when scored with score lines 20. Score lines 20 may be disposed in the valleys of serpentine inner layer 34 as shown in FIG. 6. Score lines 20 function best with corrugated materials when the score lines run parallel with the corrugations. As such, when a slip sheet with two perpendicular tabs 6 is desired, a pair of corrugated slip sheets may be secured together at right angles to provide the configuration. The bases 4 may be secured with mechanical connectors, adhesive, and/or welds. When slip sheet 2 is thermoformed, tabs 6 may be formed in the raised configuration and score lines 20 are not used.

Figure 7:
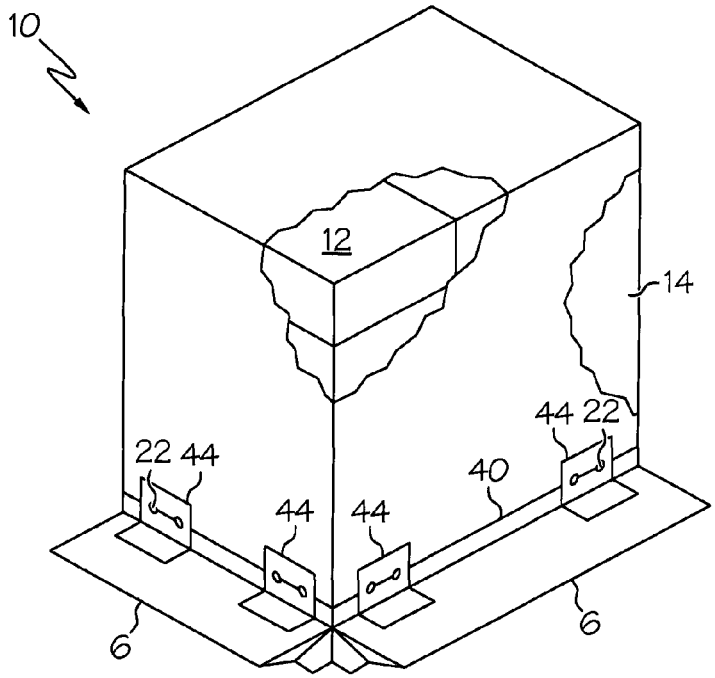
FIG. 7 is a perspective view of a unitized load of articles arranged on a slip sheet having a pair of perpendicular tabs which both have a pair of banding anchors.

Those who assemble unitized loads 10 on slip sheets 2 and slip trays 102 desire to secure loads 10 with packaging bands 40 that help stabilize load 10 and secure load 10 to slip sheet 2. Any of a variety of packaging bands 40 may be used. Slip tray 2 may be provided with banding anchors 42 and 44 so that bands 40 may be directly secured to slip sheet 2. Banding anchors 42 are flaps extending from the edge of base 4. Each flap defines at least one banding opening 22. Banding anchors 44 are portions of tabs 6 that are independently movable with respect to base 4. Anchors 44 fold upwardly from tab 6 leaving anchor openings in tab 6. Anchors 44 do not extend all the way through tab 6 such that tab 6 remains a unitary element. Both types of banding anchors 42 and 44 may be pivoted up against the side of load 10 as shown in FIG. 7 to receive packaging bands 40. The location, sizing, and number of banding anchors 42 and 44 may be configured to cooperate with automated or partially automated banding equipment in order to reduce the amount of manual labor spent in banding loads 10. The drawings depict banding anchors used on all four edges of slip sheet 2. Other configurations may be formed such as a slip sheet 2 with banding anchors on two opposite edges of base 4. Load 10 may be banded horizontally, vertically, or a combination of both. Tabs 42 and 44 may be formed in a variety of shapes and sizes. Tabs 42 and 44 may be folded up and wrapped inside stretch wrap 14 when bands 40 are not used.

Figure 2:
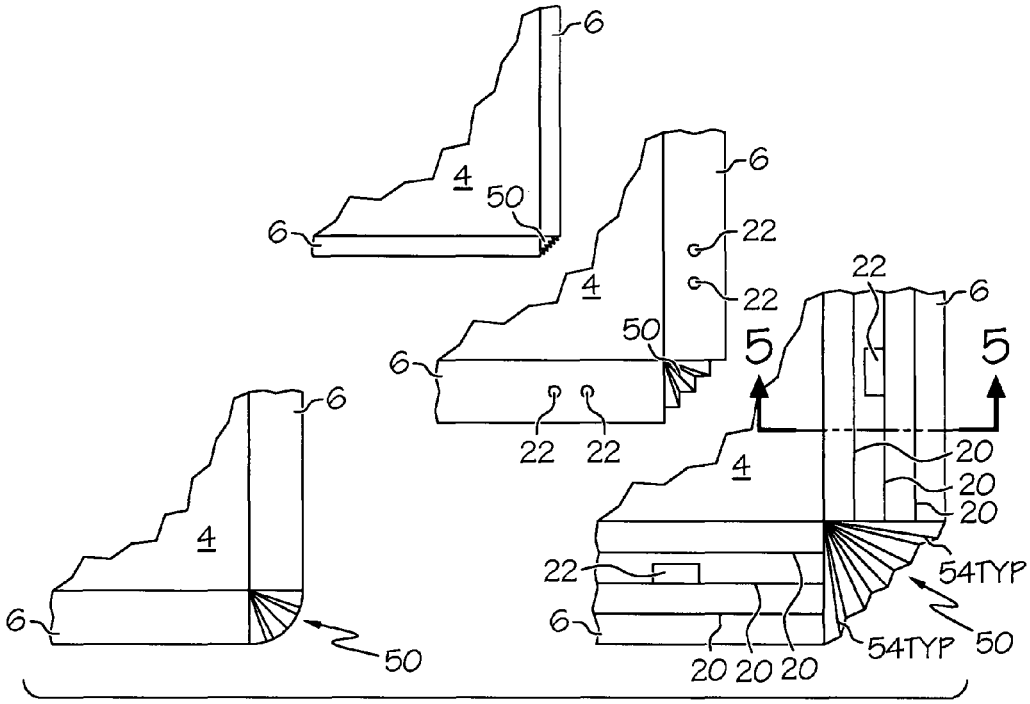
FIG. 2 depicts four exemplary webbed corners; three with crenulated outer edges and one with a rounded outer edge.
Figure 3:
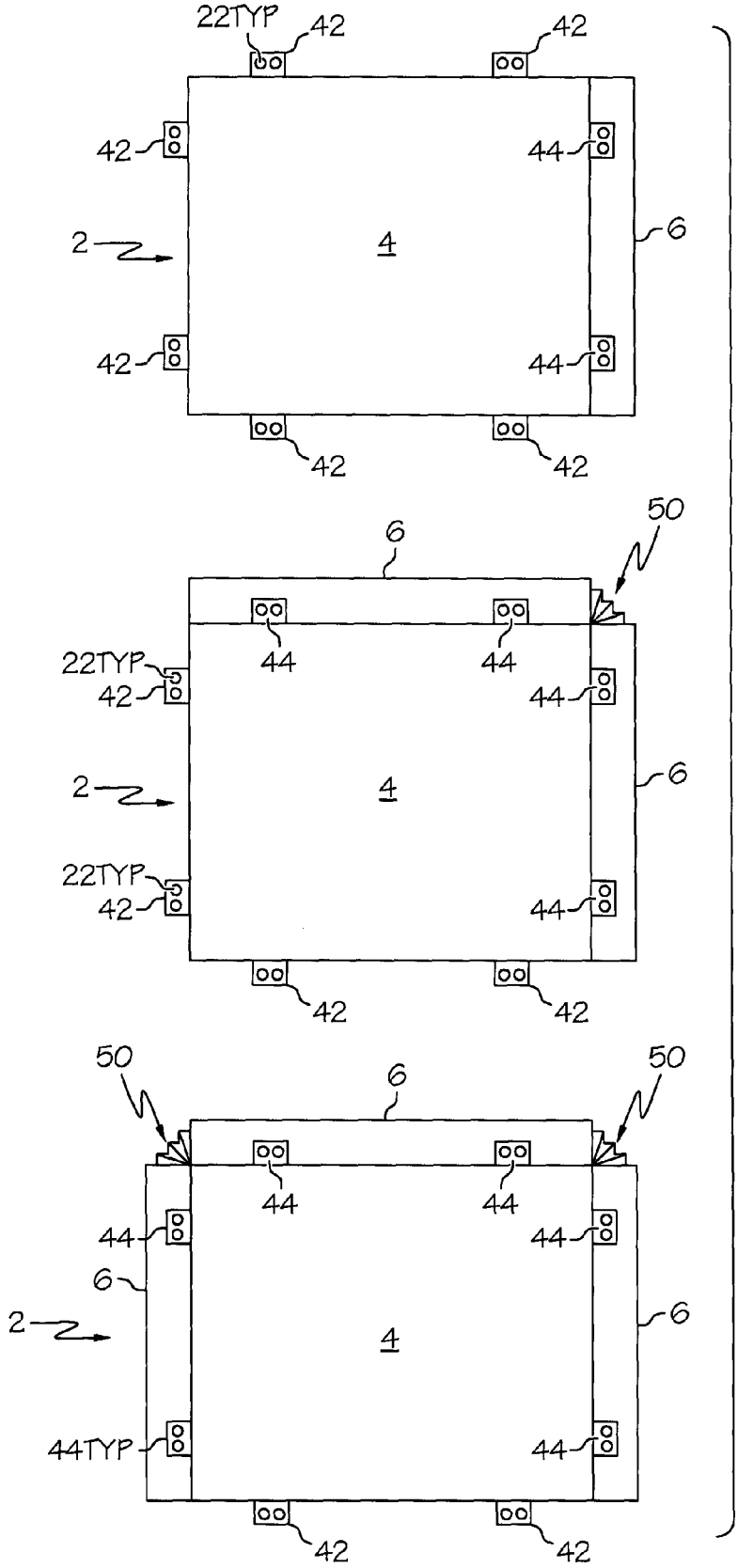
FIG. 3 depicts three slip sheet examples incorporating the banding anchors and webbed corners.

Slip sheet 2 may also include a webbed corner 50 disposed between adjacent tab ends 52. Webbed corner 50 is scored with an array of score lines 54 to allow corner 50 to help keep tabs 6 lifted with respect to base 4. Score lines 54 allow corner 50 to be fan folded when tabs 6 are lifted with respect to base 4. When slip sheet 2 is thermoformed, corners 50 may be formed in the shape of a fan without score lines or folding. Webbed corner 50 also eliminates an exposed tab end 52 that may snag load 10. A slip sheet 2 with four webbed corners 50 will hold a volume of liquid without leaking. FIG. 2 depicts a variety of different corner configurations both with smooth outer edges and crenulated outer edges.

Figure 4:
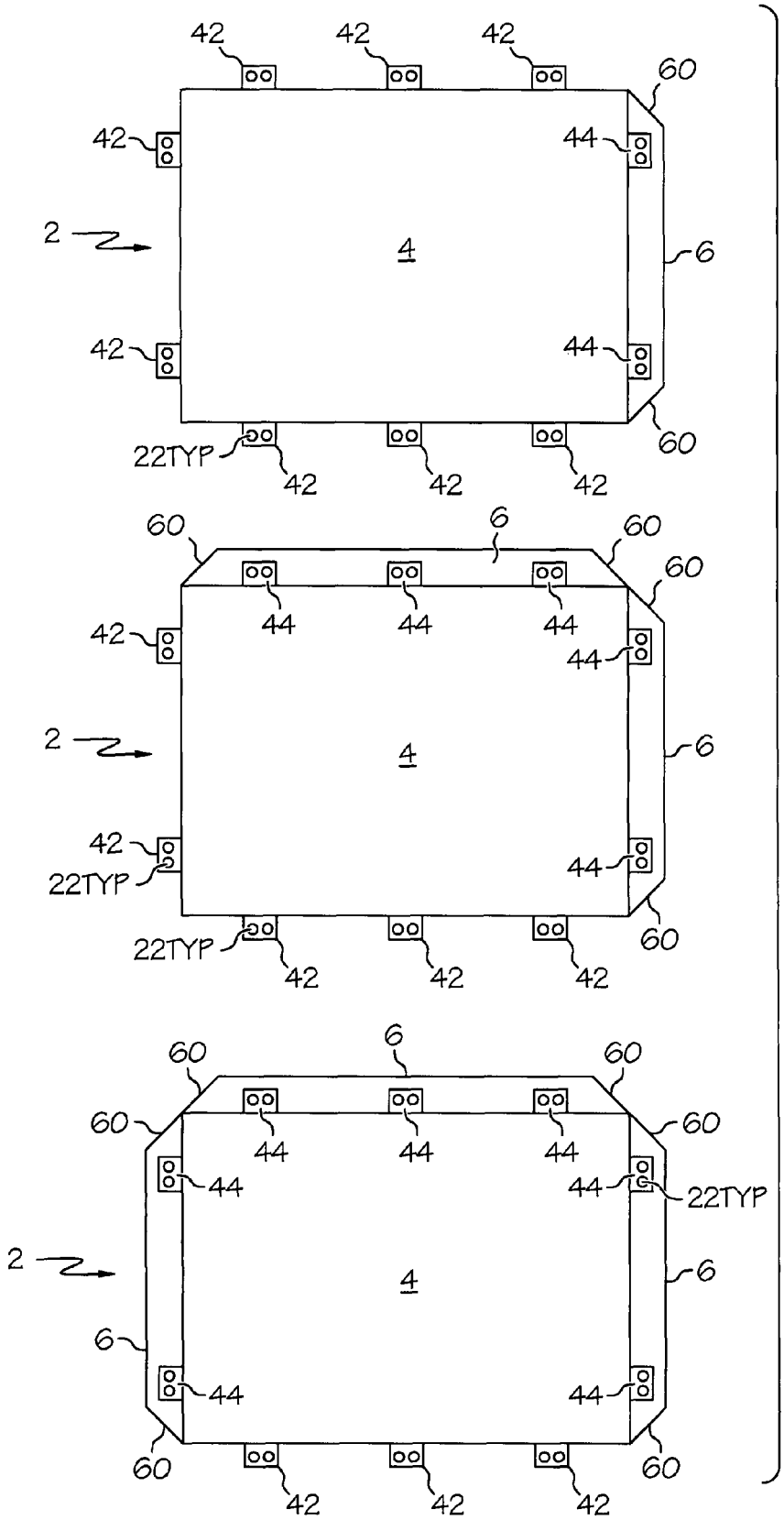
FIG. 4 depicts three slip sheet examples having the angled tab ends.

FIG. 4 depicts an alternative corner configuration that reduces the opportunities for tab 6 snagging. The slip sheets 2 depicted in FIG. 4 have angled tab ends 60. Angled tab ends 60 may be configured to define a straight surface between adjacent end walls 60 as shown in FIG. 4.

Figure 5:
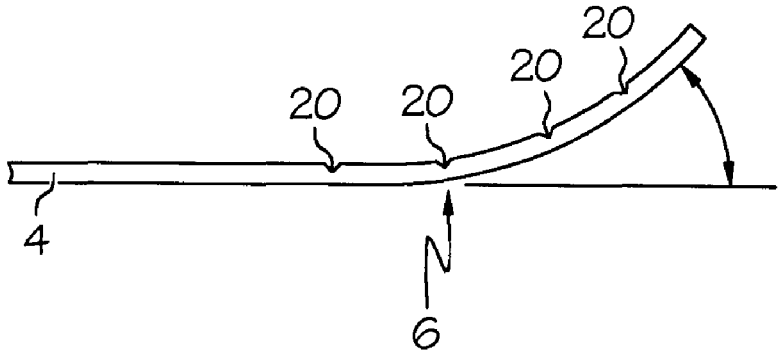
FIG. 5 is a section view taken along line 5-5 of FIG. 2.
Figure 8:
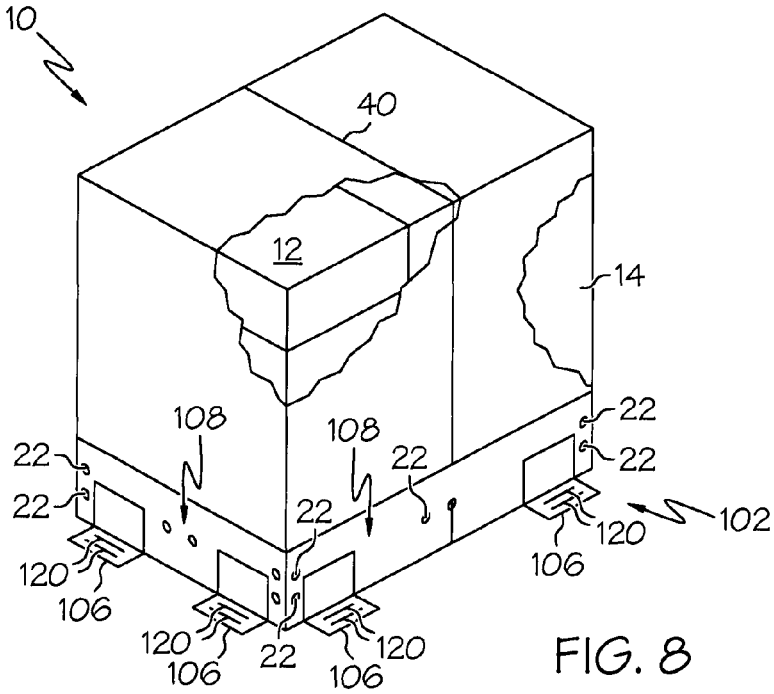
FIG. 8 is a perspective view of a unitized load of articles arranged on a slip tray having four flaps that are folded down to act as tabs for the slip tray.

FIG. 8 depicts a unitized load 10 formed on slip tray 102 having fold down tabs 106. Tabs 106 are defined from portions of the sidewall 108 of tray 102 in a manner similar to anchors 44. Tabs 106 thus form tab openings that do not break sidewall into separate sections. Tabs 106 may be used for the same purposes as tabs 6 on slip sheets 2. Each tab 106 may be scored with score lines 20 to have a curved configuration similar to the examples shown in FIGS. 5 and 6. Tabs 106 may be located at the balancing points where a forklift should pick up load 10 for maximum stability (assuming load 10 is properly assembled). Tabs 106 may be formed on one, two, three, or four sides of tray 102. Tabs 106 may be tucked under a horizontal band (not shown) that is wrapped around tray 102 or may be tucked under stretch wrap 14. Alternatively, tabs 106 may define banding openings 22 so that tabs 106 may be directly banded in a raised configuration.

Figure 9:
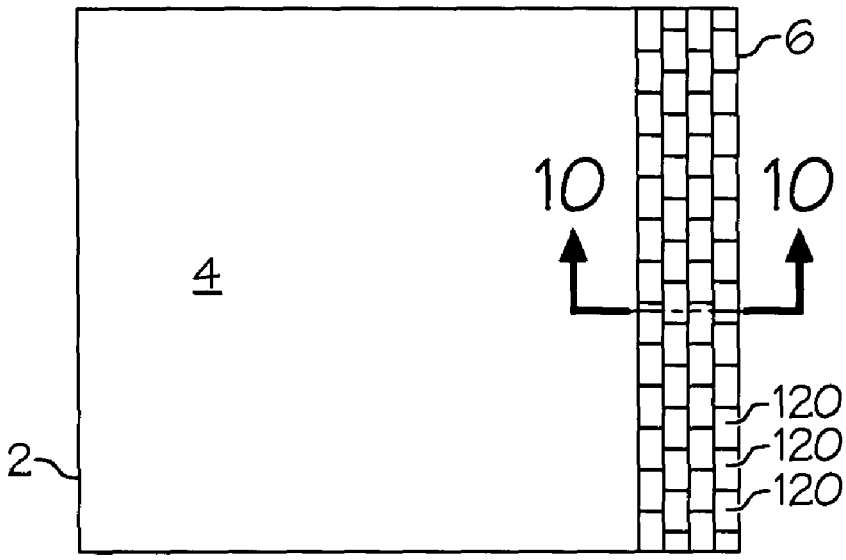
FIG. 9 is a top plan view of a slip sheet having a tab with a plurality of indentations.
Figure 10:
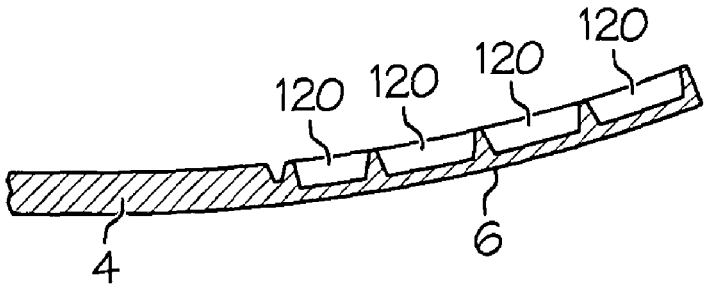
FIG. 10 is a section view taken along line 10-10 of FIG. 9.

FIGS. 9 and 10 depict an embodiment of slip sheet 2 wherein tab 6 is formed with a plurality of indentations 120. Indentations 120 also may be formed over a portion of or the entire base 4 of slip sheet 2. Indentations 120 provide rigidity to tab 6 which helps it stay up away from the floor and retain its function after multiple uses. The shape and arrangement of indentations is exemplary. Indentations 120 also make tab 106 easier to grip.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A slip sheet comprising:

a slip sheet body having a base and at least a first tab;

the base having a plurality of edges: the first tab connected to the base at one of the edges;

the first tab defining at least a portion of an anchor opening;

a plurality of banding anchors connected to the slip sheet body; each of the banding anchors defining a banding opening; each banding anchor adapted to be bent upwardly with respect to the base;

each of the banding anchors being pivotable upward with respect to the first tab;

one of the banding anchors being aligned with the anchor opening defined by the first tab; and the first tab is connected to the base at a pivot axis; the banding anchor that is aligned with the anchor opening being connected to the base at the pivot axis.

2. The slip sheet of claim 1, wherein the banding anchor that is aligned with the anchor opening does not completely divide the tab into separate portions.

3. The slip sheet of claim 1, wherein the first tab is curved upwardly with respect to the base.

4. The slip sheet of claim 3, wherein the first tab is scored.

5. A slip sheet comprising:

a slip sheet body having a base and at least a first tab;

the base having a plurality of edges; the first tab connected to the base at one of the edges;

the first tab defining at least a portion of an anchor opening;

a plurality of banding anchors connected to the slip sheet body; each of the banding anchors defining a banding opening; each banding anchor adapted to be bent upwardly with respect to the base;

each of the banding anchors being pivotable upward with respect to the first tab;

one of the banding anchors being aligned with the anchor opening defined by the first tab; and the slip sheet body including a second tab disposed perpendicular to the first tab; each of the tabs having a pair of tab ends; and two of the tab ends being adjacent and further comprising a webbed corner disposed between and connected to each of the adjacent tab ends.

6. The slip sheet of claim 1, wherein the base and tab are formed from a corrugated polymer.

7. The slip sheet of claim 1, wherein the tab defines a plurality of indentations.

8. A slip sheet comprising:

a slip sheet body having a base and at least a first tab;

the base having a plurality of edges; the first tab connected to the base at one of the edges;

the first tab defining at least a portion of an anchor opening;

a plurality of banding anchors connected to the slip sheet body; each of the banding anchors defining a banding opening; each banding anchor adapted to be bent upwardly with respect to the base;

each of the banding anchors being pivotable upward with respect to the first tab;

one of the banding anchors being aligned with the anchor opening defined by the first tab; and the banding anchors being disposed on all edges of the base.

9. A slip tray comprising:

a base and a sidewall; the sidewall defining a tab opening;

at least one tab being aligned with the tab opening defined by the sidewall; the tab being bent down with respect to the sidewall to function as a slip sheet tab; and wherein the sidewall is connected to the base at a joint and the tab being connected to the base at the joint.

10. The slip tray of claim 9, wherein the tab is curved in cross section.

11. The slip tray of claim 10, wherein the tab is scored.

12. The slip tray of claim 9, wherein the sidewall defines a plurality of banding openings.

13. A slip sheet comprising:

a slip sheet body having a base and a first tab;

the base having a plurality of edges; the base adapted to receive a plurality of goods;

the first tab connected to one of the edges of the base;

a plurality of banding anchors connected to the slip sheet body; each of the banding anchors defining a banding opening; each banding anchor adapted to be bent upwardly with respect to the base such that the banding anchor is disposed next to a portion of the goods;

the first tab defining an anchor opening and one of the banding anchors being aligned with the anchor opening defined by the first tab;

at least one of the banding anchors projecting from an edge of the base that is opposite to the first tab; and wherein the first tab is connected to the base at a pivot axis; the banding anchor being aligned with the anchor opening defined by the first tab being connected to the base at the pivot axis.

14. The slip sheet of claim 13, wherein the banding anchor being aligned with the anchor opening defined by the first tab does not completely divide the tab into separate portions.

15. The slip tray of claim 9, wherein the tab being aligned with the tab opening defined by the sidewall does not completely divide the sidewall into separate portions.

16. A slip sheet comprising:

a base having a plurality of edges;

a first tab connected to the base at one of the edges; the first tab having a longitudinal dimension;

a second tab connected to the base at another of the edges; the second tab having a longitudinal dimension;

the longitudinal dimension of the second tab being disposed perpendicular to the longitudinal dimension of the first tab;

each of the tabs having a pair of tab ends;

two of the tab ends being adjacent; and a webbed corner disposed between and connected to the two adjacent tab ends.

17. A slip sheet comprising:

a base having a plurality of edges;

a first tab connected to the base at one of the edges; the first tab defining an anchor opening adjacent the edge of the base;

a banding anchor connected to the base at the location of the anchor opening defined by the first tab;

the banding anchor defining a banding opening;

the banding anchor adapted to be bent upwardly with respect to the base to a different position than the first tab;

wherein the slip sheet includes a second tab disposed perpendicular to the first tab; each of the tabs having a pair of tab ends; two of the tab ends being adjacent; and a webbed corner disposed between and connected to each of the adjacent tab ends.

18. The slip sheet of claim 17, wherein the base, first tab, and banding anchor are formed from a corrugated polymer having a plurality of elongated corrugations; and the corrugations being disposed substantially parallel to the edge of the base where the first tab is connected to the base.

19. The slip sheet of claim 17, further comprising a second banding anchor connected to the base at an edge of the base opposite to the first tab.

20. The slip sheet of claim 16, wherein the webbed corner is defined by a plurality of score lines.

21. The slip sheet of claim 16, further comprising third and fourth tabs connected to the base; each of the third and fourth tabs having a pair of tab ends such that the slip sheet has eight tab ends arranged in four adjacent pairs of tab ends; and a webbed corner being disposed between each pair of adjacent tab ends such that the slip sheet is adapted to retain liquid between the base, the tabs, and the webbed corners.

22. A slip sheet comprising:

a slip sheet body having a base and at least a first tab; the first tab being connected to the base;

the first tab defining at least a portion of an anchor opening;

a banding anchor connected to the slip sheet body; the banding anchor adapted to be bent upwardly with respect to the base;

the banding anchor being pivotable upward with respect to the first tab;

the banding anchor being aligned with the anchor opening defined by the first tab; and wherein the first tab is connected to the base at a pivot axis; the banding anchor being connected to the base at the pivot axis.

23. The slip sheet of claim 22, wherein the banding anchor does not completely divide the tab into separate portions.

24. A slip sheet comprising:

a slip sheet body having a base and at least four tabs being connected to the base;

each of the four tabs defining at least a portion of an anchor opening;

at least four banding anchors connected to the slip sheet body; each of the banding anchors being adapted to be bent upwardly with respect to the base;

each banding anchor being aligned with one anchor opening defined by the tabs; and each of the banding anchors being pivotable upward with respect to the tabs.

25. The slip sheet of claim 24, wherein each tab is connected to the base at a pivot axis; each banding anchor being connected to the base at the pivot axis.

26. A slip sheet comprising:

a slip sheet body having a base and at least a first tab; the base adapted to receive the goods to be moved by the slip sheet;

the base having a plurality of edges; the first tab connected to the base at one of the edges;

a plurality of banding anchors pivotably connected to the slip sheet body; each of the banding anchors defining a banding opening; and each of the banding anchors being initially pivotable upward in a rotational direction toward the base.

27. The slip sheet of claim 26, wherein the first tab defines at least a portion of an anchor opening; one of the banding anchors being aligned with the anchor opening.

28. The slip sheet of claim 27, wherein the anchor opening does not completely divide the tab into separate portions.

29. The slip sheet of claim 28, wherein each banding anchor has a free edge; the connection of the banding anchor with the slip sheet body being disposed between the free edge of the banding anchor and the base of the slip sheet body when the banding anchor is disposed within the anchor opening.

* * * * *